United States Patent [19]

Parisek

[11] Patent Number: 4,703,561

[45] Date of Patent: Nov. 3, 1987

[54] THUMB MOUNTABLE CUTTING TOOL

[76] Inventor: Richard H. Parisek, 3925 W. Palmaire, Phoenix, Ariz. 85021

[21] Appl. No.: 813,577

[22] Filed: Dec. 26, 1985

[51] Int. Cl.[4] ..... B26B 27/00

[52] U.S. Cl. ..... 30/298

[58] Field of Search ..... 30/291, 298

[56] References Cited

U.S. PATENT DOCUMENTS

| | | | |
|---|---|---|---|
| 1,028,667 | 6/1912 | Billau | 30/298 |
| 1,801,630 | 4/1931 | Ketterer | 30/298 |
| 2,380,186 | 7/1945 | Mayer | 30/298 X |
| 2,572,245 | 10/1951 | Coldiron | 30/298 X |

FOREIGN PATENT DOCUMENTS

| | | | |
|---|---|---|---|
| 149831 | 8/1920 | United Kingdom | 30/298 |

*Primary Examiner*—Donald R. Schran

*Assistant Examiner*—Michael D. Folkerts

*Attorney, Agent, or Firm*—H. Gordon Shields

[57] ABSTRACT

Thumb mountable cutting tool includes a sleeve which receives a thumb of the user and a blade is secured to and extends longitudinally along the sleeve. The tool is placed on the user's thumb, with the blade extending away from the hand, or along the outside portion of the thumb or the top portion of the thumb, and is accordingly in position for cutting tape by a cutting motion of the hand or the thumb. The blade is preferably a serrated blade to facilitate cutting tape and at the same time to prevent possible injuries which may occur if the blade were smooth and continuous. The serrated edge readily cuts all kinds of tape, including tape with fibers embedded therein. For cutting boxes, the tool may be removed from the thumb and held in the hand for additional leverage and ease of cutting in different directions as may be required in opening boxes.

7 Claims, 7 Drawing Figures

THUMB MOUNTABLE CUTTING TOOL

BACKGROUND OF THE INVENTION

1. Field of the Invention:

This invention relates to cutting tools and, more particularly, to a thumb mountable cutting tool adapted for cutting packing tape.

2. Description of the Prior Art:

In the general field of packing boxes, as in the packing of household goods for shipment, and in the packing of boxes for the shipment of miscellaneous goods, tape is generally used to seal the boxes. For cutting the tape, a packer typically must stop, remove at least one hand from the tape and from the box or carton, pick up a knife or scissors, and then cut the tape. In many instances, it is necessary or desirable to have two people involved, since the holding of the tape and the carton may require two hands, and the second person is then required to cut the tape.

Other than the use of a knife or scissors to cut tape, there is a tool available which holds a roll of tape and which includes a cutting edge built into the apparatus adjacent to the tape. The tool is held in one hand, and the tape is applied directly from the dispenser tool. The cutting of the tape is accomplished at the end of the application of the tape. Such apparatus is relatively large and heavy and is thus rather cumbersome to use. It is also rather expensive to buy.

Razor blades are occasionally used to cut tape, but knives and scissors are preferred. Typically, the knives used are either pocket knives or utility knives.

SUMMARY OF THE INVENTION

The invention described and claimed herein comprises a thumb mountable cutting tool which includes a sleeve which receives the thumb of the user, and a blade extends longidudinally along the sleeve and generally diametrically or radially outwardly from the sleeve for cutting tape and boxes. When removed from the thumb, the sleeve comprises a handle for holding and using the apparatus.

Among the objects of the present invention are the following:

to provide a new and useful cutting tool;

to provide a new and useful cutting tool secured to a sleeve;

to provide a new and useful cutting tool adapted to be mounted on a user's thumb;

to provide a new and useful thumb mountable cutting tool having a sleeve and a serrated blade extending longitudinally of the sleeve; and to provide a new and useful cutting tool having a sleeve for receiving a thub, and a blade secured to the sleeve, and the sleeve may be used as a handle for the cutting blade when the sleeve is removed from a user's thumb.

DESCRIPTION OF THE PREFERRED EMBODIMENT

Figure 1:
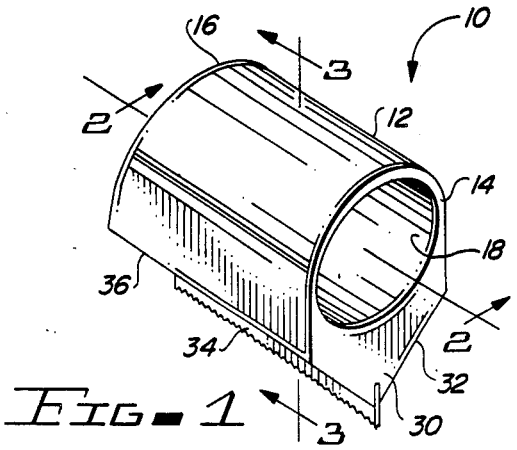
FIG. 1 is a perspective view of the apparatus of the present invention.

FIG. 1 is a perspective view of cutter apparatus 10 of the present invention. The cutter apparatus 10 includes a cylindrical body 12. The cylindrical body preferably includes a "straight" end 14, and an "angled" end 16. The straight end and angled ends are on opposite ends of the cylindrical body 12. Extending through the cylindrical body 12 is a thumb bore 18. The term "straight" indicates that the end 14 is substantially perpendicular to the longitudinal axis of the bore 12. The term "angled" indicates that the plane of the end 16 is not perpendicular to the longitudinal axis of the bore 18.

Extending downwardly from the cylindrical body 12 is a cutter boss 30. The cutter boss 30 includes a pair of generally flat sides 32 and 36, which extend the full length of the cylindrical body 12 and which terminate in an edge which holds a blade 34. The flats 32 and 36 taper towards each other from the body 12.

Figure 2:
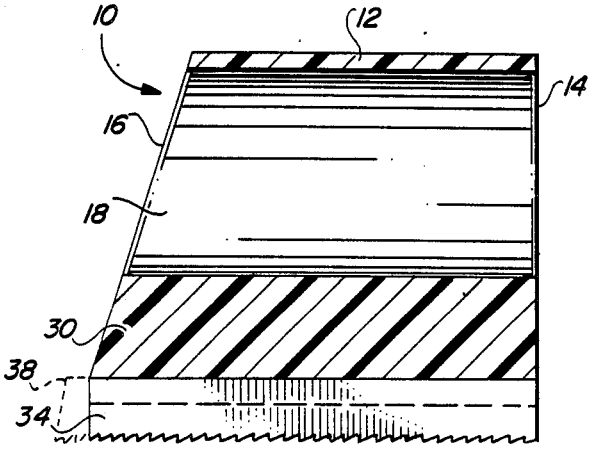
FIG. 2 is a view in partial section taken generally along line 2—2 of FIG. 1.

FIG. 2 is a view in partial section through the cylindrical body 12 and the cutter boss 30. FIG. 2 is taken generally along line 2—2 of FIG. 1. FIG. 2 is generally taken along the longitudinal axis of the cutter apparatus 10, and accordingly discloses the full longitudinal length of the thumb bore 18. The longitudinal axis of the apparatus 10 is generally parallel to the longitudinal axis of the bore 18.

Figure 3:
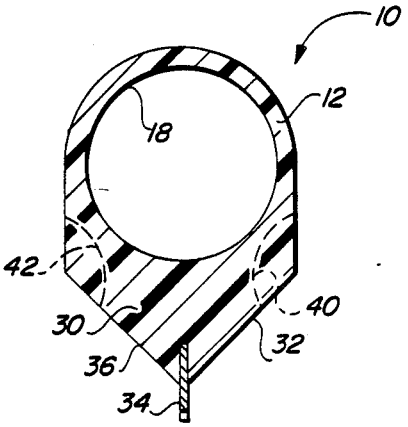
FIG. 3 is a view in partial section taken generally along line 3—3 of FIG. 1.

FIG. 3 is also a view in partial section, but taken along line 3—3 of FIG. 1, and which is generally perpendicular to the view comprising FIG. 2. Thus, FIG. 3 is taken generally diametrically through the cylindrical body 12, and the cutter boss 30. FIG. 3 illustrates the tapering configuration of the flats 32 and 36, with the blade 34 at the "apex" of juncture of the sides 32 and 36.

Figure 6:
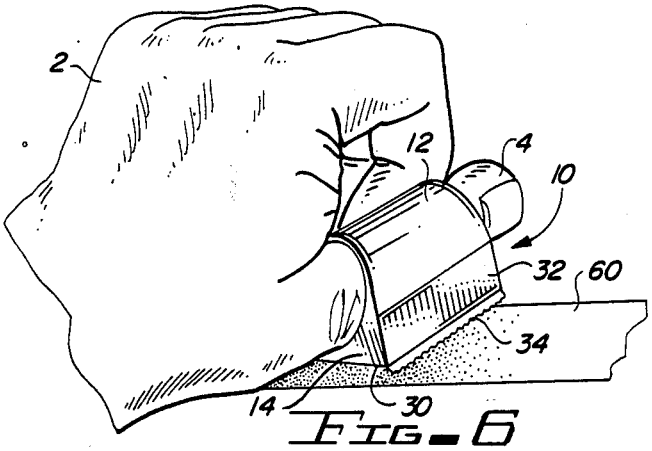
FIG. 6 is a perspective view illustrating the operation of the apparatus of the present invention.
Figure 7:
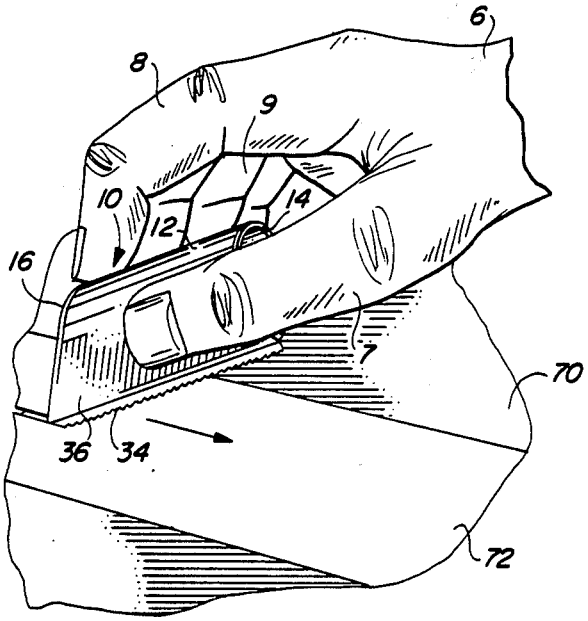
FIG. 7 is a perspective view illustrating another operation of the apparatus of the present invention.
Figure 4:
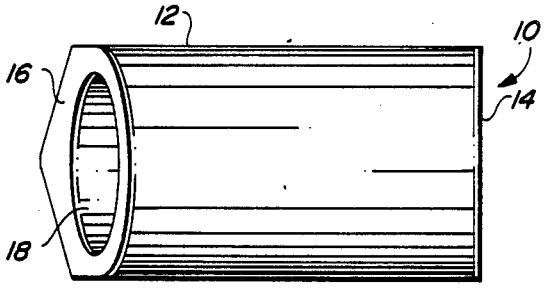
FIG. 4 is a top view of the apparatus of the present invention.
Figure 5:
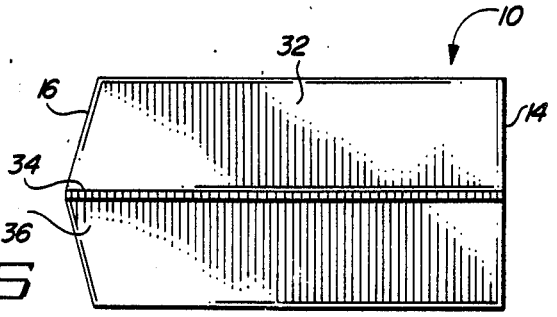
FIG. 5 is a bottom view of the apparatus of the present invention.

FIG. 4 is a top view of the cutter apparatus 10, while FIG. 5 is a bottom view of the cutter apparatus 10. FIGS. 6 and 7 illustrate the operation of the cutter apparatus 10. FIG. 6 shows the cutter apparatus 10 disposed on a thumb 4 of a left hand 2 of a user. FIG. 7 illustrates the cutter apparatus 10 held by a user's right hand 6, and specifically by a thumb 7, an index finger 8, and a middle finger 9, of the right hand 6. For the following description of the cutter apparatus 10, reference will be made to all of the Figures in the drawing.

The cylindrical body 12 may be made of any appropriate material, such as wood, plastic, etc. As illustrated herein, the cylindrical body 12, with its cutter boss 30 secured to it as an integral part thereof, is preferably made of extruded or molded material, with the blade 34 disposed in a slot extending generally longitudinally of the apparatus 10. The diameter of the thumb bore 18 is sufficiently large to accommodate the user's thumb, but should not be excessively large so that the thumb is "swallowed" by the bore 18. Similarly, the diameter of the bore 18 should not be so small so as to provide an uncomfortable fit with a thumb extending through it. The overall axial length of the apparatus 12 is sufficient to provide a blade 34 of the approximate width of tape which the apparatus 10 is primarily designed to cut. Thus, the overall length of the cutter apparatus 10 is preferably about two inches or more long, since packing tape is typically about two inches wide. In metrics, the blade is preferably about fifty millimeters long.

The cutter blade 34 is preferably a serrated blade. The serrated blade has advantages over a smooth blade in that it is more difficult to accidentally cut oneself with a serrated blade, and a serrated blade may be more effective in cutting tape with integral reinforcing strands.

The cutter boss 30 places the blade 34 at an appropriate, convenient distance from the thumb of the user, such as the thumb 4 illustrated in FIG. 6. In FIG. 6, the thumb 4 and the cutter blade 34 of the apparatus 10 are shown disposed adjacent to a portion of tape 60 which the cutter apparatus 10 will be cut.

As will be understood from FIG. 6, a relatively short movement of the hand 2, or specifically of the thumb 4, is all that is required to sever the tape 60. It will be noticed, primarily from FIG. 6, that the hand 2 is relatively unemcumbered by the cutter apparatus 10.

With the cutter boss 30, and the blade 34, extending away from the thumb 4, and thus away from the hand 2, the hand 2 is free for any desired activities, virtually without limitation. Thus, the hand 2, with its four fingers and its thumb 4, is available to smooth the tape 60 along a seam, etc. Then, when it is desired to sever or to cut the tape 60, a relatively short movement of the thumb 4 or the hand 2 is all that is required to bring the cutter blade 34 against the tape 60. At the same time, the blade 34 is directed away from the hand 2 on the back of the thumb 4, and thus away from any activity of the hand 2 and away from anything held by the hand.

While the hand 2 is occupied with other than the use of the cutter 10, but while the cutter 10 is on the thumb 4, the slanted end 16 of the cylindrical body 12 allows the user to have the inside tip of the thumb available for use, as in holding, grasping, etc., where the thumb is required.

The slanted end 16 is oriented at the outer end of the thumb. The generally flat end 14, which is substantially perpendicular to the longitudinal axis of the cylinder 4, and of the thumb bore 18, is disposed adjacent to the juncture of the thumb 4 and the hand 2. The slanted end 16 thus allows the tip of the thumb to be utilized, as desired. At the same time, the slanted end allows for the blade 34 to be as long as desired, which, as indicated above, is preferably about the width of common tape used for packing purposes, such as for the sealing of boxes, etc.

It will be noted that the slanted end 16 is cut, or extends, diagonally, with respect to the longitudinal axis of the cylindrical portion 12. Thus, the overall length of the cylinder 12 is at a maximum length adjacent to the blade 34. The length tapers, due to the slanted or diagonally extending end 16, to a minimum length remote from the blade 34. This allows the tip or end of the thumb of the user, such as the thumb 4 of the user's left hand 2, to be used in conjunction with the other fingers of the hand 2 in any desired way. At the same time, a maximum overall length of the cutter blade 34 is provided.

As shown in FIG. 7, the diagonal end 16, which tapers "rearwardly" from the blade 34, acts as a tip or front end of the cutter apparatus 10 when the cutter apparatus 10 is used as a hand-held tool.

The angle of the end 16 may be any angle desired and in accordance with the practicality of securing the apparatus 10 to a user's thumb. Thus, the taper of the end 16 away from the blade 34 may extend to a minimum overall length of the cylinder 12 remote from the blade 34. The minimum overall length of the cylinder needs only to be long enough to conveniently and securely hold the cutter apparatus 10 onto a thumb. To accommodate users of different sizes, the apparatus may be made in several lengths and in several diameters (of the bore 18). However, the overall length of the blade is still preferably a minimum of about two inches (five cm.) for maximum cutting efficiency.

If desired, the overall height (i.e., the radial length) of the cutter boss 30 may be decreased substantially without impairing the functioning of the cutter apparatus 10. However, the general height or radial length of the cutter boss 30, measured radially outwardly from the thumb bore 18, places the blade 34 outwardly from the thumb a relatively significant or substantial distance for convenience in using the cutter apparatus 10 both on the thumb 4 and as grasped by the hand 2. This is best illustrated in FIG. 7.

In FIG. 7, the cutter apparatus 10 is shown removed from the user's thumb and is being grasped in the user's right hand 6. The cutter 10 is held by the thumb 7, the index finger 8, and the middle finger 9, of the user's hand 6. The cutter apparatus 10 is disposed against a tape 72 used to seal a box 70, for purposes of opening the box 70. The blade 34 is shown making a cut along the length of the tape 72.

The flats 32 and 36 provide a surface along the cylindrical body 12 to aid in grasping the cutter apparatus 10. At the same time, the boss 30 places the blade 34 a relatively substantial distance away from the thumb bore 18 and locates it conveniently for using the apparatus 10 as a hand-held cutter, as opposed to a thumb-mounted cutter shown in FIG. 6.

If desired, the body 12 may include a pair of longitudinally extending recesses 40 and 42, shown in phantom in FIG. 3. The recesses 40 and 42 may enhance the holding of the cutter apparatus 10 when used as a hand-held cutter, as shown in FIG. 7.

It will be noted that the flat surfaces 32 and 36 may also be conveniently used for instructions, for advertising, etc. For example, instructions may be embossed on either or both of the sides, appropriate labels may be placed thereon, or other uses may be made of the flat surfaces, as desired by a manufacturer and seller of the apparatus.

An alternate way to cut open a box using the cutter apparatus 10 is to place the cutter apparatus on a thumb and have the blade 34 oriented downwardly, or ninety degrees (perpendicular) to the plane of the hand, rather than generally parallel to the plane of the hand as shown in FIG. 6. The hand and cutter may then be drawn along the box seam.

Another alternate way to open a box with the cutter apparatus 10 is to grip the cutter with the index finger placed on the slanted or angled face 16. In this manner, a downward force may be applied by the index finger. Also, the index finger may help guide the cutter apparatus along a seam between flats.

Where a cutter apparatus is to be used primarily for opening boxes, the blade 34 may include an extension 38, shown in phantom in FIG. 2. The short extension 38 allows the blade 34 to be disposed beneath the flaps on the ends of boxes to cut the tape securing the ends of the flaps.

The blade extension 38 extends outwardly beyond the end or face 16 a relatively short distance. The extension need not be long. Its purpose is simply to allow a portion of the blade in front of the body 12 to cut through the tape and extend beneath a flap so that the blade will remain beneath the flap as it is drawn along to cut the tape.

While the principles of the invention have been made clear in illustrative embodiments, there will be immediately obvious to those skilled in the art many modifications of structure, arrangements, proportions, the elements, materials, and components used in the practice of the invention, and otherwise, which are particularly adapted for specific environments and operative requirements without departing from those principles. The appended claims are intended to cover and embrace any and all such modifications, within the limits only of the true spirit and scope of the invention. This specification and the appended claims have been prepared in accordance with the applicable patent laws and the rules promulgated under the authority thereof.

What I claim is:

1. Cutter apparatus mountable on a user's thumb, comprising, in combination:

cylinder means having a longitudinal axis and including a bore of constant diameter extending the complete longitudinal length of said cylinder means for receiving a user's thumb and through which the user's thumb extends, said cylinder means comprising a cylindrical body through which said bore extends, and a cutter boss extending radially outwardly from the cylindrical body for providing a holding surface; and blade means secured to the cutter boss and extending in a direction radially outwardly from the cylindrical body substantially parallel to the longitudinal axis and spaced a substantial distance away from the bore;

said cylinder means further comprising a first end and a second end, said first end being substantially perpendicular to the longitudinal axis, and said second end extending diagonally with respect to the longitudinal axis of the cylinder means for allowing the tip of the user's thumb to extend outwardly from the cylindrical body, such that the cylinder means tapers from a maximum length adjacent to the blade to a minimum length remote from the blade.

2. The apparatus of claim 1 in which the blade means includes a blade secured to the cutter boss.

3. The apparatus of claim 2 in which the blade of the blade means includes a serrated edge.

4. The apparatus of claim 2 in which the cutter boss of the cylinder means includes a generally flat portion.

5. The apparatus of claim 4 in which the generally flat portion is disposed adjacent to the blade.

6. The apparatus of claim 2 in which the cutter boss includes a first flat portion and a second flat portion adjacent to the blade.

7. The apparatus of claim 1 in which the cutter boss includes recess means in said holding surface for holding the apparatus by a user.

* * * * *